US009080396B2

(12) United States Patent
Overland

(10) Patent No.: US 9,080,396 B2
(45) Date of Patent: Jul. 14, 2015

(54) TELESCOPIC ELEVATOR BAIL AND METHOD OF USING THE ELEVATOR BAIL

(75) Inventor: Morten Overland, Stavanger (NO)

(73) Assignee: Scan Tech Produkt AS, Stavanger (NO)

( * ) Notice: Subject to any disclaimer, the term of this patent is extended or adjusted under 35 U.S.C. 154(b) by 287 days.

(21) Appl. No.: 13/805,307

(22) PCT Filed: Jun. 23, 2011

(86) PCT No.: PCT/NO2011/000179
§ 371 (c)(1),
(2), (4) Date: Jan. 17, 2013

(87) PCT Pub. No.: WO2011/162617
PCT Pub. Date: Dec. 29, 2011

(65) Prior Publication Data

US 2013/0105168 A1 May 2, 2013

(30) Foreign Application Priority Data

Jun. 24, 2010 (NO) ..... 20100915
Jun. 14, 2011 (NO) ..... 20110852

(51) Int. Cl.
*E21B 19/06* (2006.01)
*E21B 19/07* (2006.01)

(52) U.S. Cl.
CPC ..... *E21B 19/06* (2013.01); *E21B 19/07* (2013.01)

(58) Field of Classification Search
CPC ..... E21B 19/06; E21B 19/07; E21B 19/16
USPC ..... 166/338, 75.11, 77.52, 75.14, 352, 355, 166/364
See application file for complete search history.

(56) References Cited

U.S. PATENT DOCUMENTS 1,397,072 A 11/1921 Black
2,215,049 A 9/1940 Minor
(Continued)

FOREIGN PATENT DOCUMENTS

EP 0 079 846 A1 5/1983
GB 2350628 A 12/2000
(Continued)

OTHER PUBLICATIONS

International Search Report for parent application PCT/NO2011/000179, having a mailing date of Jan. 10, 2012.
Written Opinion for parent application PCT/NO2011/000179, having a mailing date of Jan. 10, 2012.
(Continued)

*Primary Examiner* — James G Sayre
(74) *Attorney, Agent, or Firm* — Andrus Intellectual Property Law, LLP

(57) ABSTRACT

A telescopic elevator bail is arranged to be able to be used dynamically in well operations in the petroleum industry. The elevator bail comprises a sleeve provided with a first attachment organ and a muzzle portion, and a rod arranged to be able to be displaced telescopically relative to the sleeve along the common longitudinal axis of the sleeve and the rod. The rod is provided with at least one through hole perpendicularly to the longitudinal axis of the rod and the hole is arranged to be able to accommodate an actuator actuable holding bolt. The sleeve is provided with at least one catch bolt. The catch bolt is provided with an inward projecting holding portion. The rod is provided with a first shoulder portion arranged to rest on the holding portion of the catch bolt when the sleeve and the rod exhibit their relatively longest longitudinal displacement. A method is for utilizing the elevator bail.

22 Claims, 8 Drawing Sheets

(56) References Cited

U.S. PATENT DOCUMENTS

| | | | | |
|---|---|---|---|---|
| 2,496,360 | A * | 2/1950 | Stone | 294/96 |
| 3,351,372 | A | 11/1967 | Marks et al. | |
| 6,000,472 | A * | 12/1999 | Albright et al. | 166/380 |
| 8,191,621 | B2 * | 6/2012 | Sweeney et al. | 166/77.52 |
| 2005/0098352 | A1 | 5/2005 | Beierbach et al. | |
| 2007/0169930 | A1 * | 7/2007 | Shahin et al. | 166/77.52 |
| 2012/0227976 | A1 * | 9/2012 | Barone et al. | 166/355 |

FOREIGN PATENT DOCUMENTS

| | | | | |
|---|---|---|---|---|
| NO | 20084595 | A | 4/2010 | |
| WO | WO 9934088 | A1 * | 7/1999 | E21B 19/16 |
| WO | 2005/121493 | A2 | 12/2005 | |

OTHER PUBLICATIONS

Preliminary Report for parent application PCT/NO2011/000179, having a completion date of May 22, 2012.

* cited by examiner

TELESCOPIC ELEVATOR BAIL AND METHOD OF USING THE ELEVATOR BAIL

CROSS-REFERENCE TO RELATED APPLICATIONS

This application is the U.S. national stage application of International Application No. PCT/NO2011/000179, filed Jun. 23, 2011, which International application was published on Dec. 29, 2011 as International Publication No. WO 2011/162617 A2 and A3 in the English language, and which application is incorporated herein by reference. The International application claims priority of Norwegian Patent Application Nos. 20100915, filed Jun. 24, 2010, and 20110852, filed Jun. 14, 2011, which applications are incorporated herein by reference.

BACKGROUND

The invention relates to an elevator bail for use in drilling operations, well testing and well maintenance operations. Particularly the invention relates to an elevator bail for use on a vessel conducting such operations above a riser from a seabed.

It is well known within the art that it is a challenge to operate floating drilling rigs and drill ships in a safe manner at all times, when work is carried out above a riser extending from the seabed and up to the vessel, so-called Work Over Riser (WOR) operations. WOR systems dimensioned for steadily increasing pressures combined with that WOR operations are taking place at all times of the year in exposed regions, has increased the likelihood of an uncontrolled situation and damage to equipment in well testing and WOR operations.

In certain situations tension between an equipment in the well and the vessel exceeds the structural strength of the vessel heave compensator, drilling derrick and lifting equipment. Such situations may for example arise at an unexpected high wave and drift-off of the vessel. Modern equipment for well testing may be so heavy that the tension in the drill pipe may exceed the dimensioning maximum load for the vessel lifting equipment. The vessel will stand waves up to the maximum of the heave compensator working range. In certain weather conditions wave heights exceeding the heave compensator working range may occur, and breakage may occur when the heave compensator is maximum outstretched. It is a requirement that such a breakage shall be controlled in such a manner that the breakage occurs in a place it is expected to, thereby avoid damage to personnel and equipment. There is thus a need to introduce a weakened connection giving a controlled breakage to avoid extensive damage.

The riser is arranged to the vessel in such a way that the vessel may move with the waves and such that the riser top moves relative to the vessel work deck. Wireline or coiled tubing is led up and down in the riser by means of a lift. The lift is connected to the heave compensator via a so-called elevator bail, generally via two elevator bails of known type. An elevator bail will typically be provided with an attachment organ in each end portion. The attachment organ may be constituted by an eye arranged to be fastened or unfastened quickly to or from hooks. The elevator bails exist in several lengths and are constituted by solid metal such as a steel alloy.

The lift is hanging in the heave compensator via elevator bails. The lift and the elevator bail are according to prior art connected through a weakened connection, a so-called weak link. Every weak link is split into an upper main part and a lower main part. The lower main part is provided with an attachment organ forming a segmented connection with the lift. The attachment organ may be an eye or a fork fastened to the lift by means of a bolt through the fork prongs. The upper main part is fastened to a lower eye in a pipe handling equipment hanging directly or indirectly in the heave compensator. A fracture bolt arranged to be broken at a predetermined tensile load holds the two main parts together. The weak link is also provided with a hydraulically displaceable bolt constituted by a strong bolt. In lifting the equipment the strong bolt is displaced into complementary openings in the two main parts of the weak link and forms a strong connection between these. When a critical work operation is to be carried out, the strong bolt is pulled out of the complementary openings and the equipment is hanging on the fracture bolt.

The known solution has at least two drawbacks. At a fracture the contact between the two main parts of the weak link is lost and there exists thus no longer a connection between the lift and the heave compensator and appurtenant lifting equipment. The equipment may no longer be lifted up before a connection between the two main parts of the weak link is recreated or that the lift is fastened directly to elevator bails hanging directly or indirectly from the heave compensator. This may not be done before the weather has improved. This also requires personnel to get out on deck, which constitutes a risk. The other drawback is that the connection between the heave compensator and the lift is constituted by an elevator bail and a weak link interconnected through a hook-to-eye connection. This forms a segmented connection being straight when a tension is applied to the lift from below, but which will move out to the side when the vessel movement is downwards and the connection is exposed to compression.

Patent document NO20084595 shows a tension frame for use in well interventions offshore. The tension frame leg is in one of its portions provided with a boring therethrough arranged to accommodate a fracture element. The fracture element may by means of an activator be displaced in its borings along its longitudinal direction between a "strong modus" where the shear forces will act on the full diameter of the fracture element, and a weak modus where the shear forces will act on the weakened portions of the fracture element. The teaching of the patent document does not solve the problem of maintaining and/or recreating the connection between the main parts in the tension frame when the fracture element is broken.

Within the art it is known to use elevator bails that are lengthwise adjustable. The patent document WO 2005/121493 shows an elevator bail comprising a sleeve part provided with an attachment eye and a rod provided with an eye that may be displaced in its longitudinal direction inside the sleeve part. The rod is attached to the sleeve part by bolts through the sleeve part and the rod. The bolts form a fixed connection. Patent document US 2005/0098352 shows an elevator bail having a central sleeve part, an upper rod provided with an attachment eye and a lower rod provided with an attachment eye. The upper rod and the lower rod may be displaced in their longitudinal directions inside the sleeve part. The rods are attached to the sleeve part by means of bolts going through the sleeve part and the respective rod. Both of these patent documents teach about statically longitudinally adjustable elevator bails, meaning that when they are in use they have fixed lengths. Changing of the elevator bail length requires that bolts are taken out of their respective through holes and are put back in after the rod has been displaced inside the sleeve part to its desired length.

SUMMARY

The object of the invention is to remedy or reduce at least one of the disadvantages of the prior art, or at least to provide a useful alternative to the prior art.

The object is achieved by the features disclosed in the below description and in the subsequent claims.

The drawbacks mentioned in prior art are overcome by forming the elevator bail and the weak link as one unit. More particularly the elevator bail is formed as a dynamically telescopable elevator bail. By dynamically telescopable is in the following meant that the sleeve and rod of the elevator bail are relatively displaceable while in use in a work operation. The telescopable elevator bail is provided with three types of bolts: at least one strong, displaceable holding bolt; at least one strong, immovable catch bolt; and at least one weakened, immovable fracture bolt. In an alternative embodiment the elevator bail is further provided with a secondary, movable fracture bolt.

In a first aspect the invention relates to a telescopic elevator bail arranged to be able to be used dynamically in well operations in the petroleum industry where the elevator bail comprises a sleeve provided with a first attachment organ and a muzzle portion, and a rod arranged to be able to be displaced telescopically relative to the sleeve along the common longitudinal axis of the sleeve and the rod; and the rod being provided with at least one hole therethrough perpendicularly to the longitudinal axis of the rod and the hole being arranged to be able to accommodate an actuator actuable holding bolt, and where the rod in its second end portion is provided with at least one first abutment portion and that the sleeve is provided with at least one first contact portion arranged to be able to support the first abutment portion of the rod when the sleeve and the rod exhibit their longest relative longitudinal displacement. The first abutment portion of the rod may project radially outside the surface of the rod. The first contact portion of the sleeve may be formed in the inner wall of the sleeve.

The rod may, in its second end portion be provided with a first shoulder portion and the sleeve may be provided with at least one catch bolt; where the catch bolt may be provided with an inward projecting holding portion. At least one axially running, straight catch groove may be formed in a portion of the rod surface and arranged to be able to accommodate the catch bolt holding portion. The first shoulder portion of the rod may project outside the rod surface. In an alternative embodiment the first shoulder portion of the rod may lie inside the rod surface.

The rod may be provided with at least one second abutment portion and the sleeve may be provided with at least a second contact portion arranged to be able to support the second abutment portion of the rod when the sleeve and the rod exhibit their longest relative working length displacement. The rod second abutment portion may project radially outside the rod surface. The sleeve second contact portion may be formed in the sleeve inner wall. The rod may be provided with a second shoulder portion and the sleeve may be provided with at least one fracture bolt; the fracture bolt may be provided with an inward projecting fracture-holding portion. The second rod shoulder portion may project outside the rod surface. In an alternative embodiment the second rod shoulder portion may lie within the rod surface. At least one axially running, straight fracture groove may be formed in a portion of the rod surface and may be arranged to be able to accommodate the fracture bolt fracture portion.

The catch bolt may be positioned between the actuator and the first sleeve attachment organ. The fracture bolt may be positioned between the actuator and the sleeve muzzle portion.

The sleeve may in an alternative embodiment be further provided with at least one length displaceable secondary fracture bolt; the secondary fracture bolt may be provided with a fracture-holding portion projecting inward in the sleeve when the secondary fracture bolt is activated. The secondary fracture bolt may be positioned between the holding bolt and the catch bolt.

The invention also comprises a vessel arranged to be able to undertake well operations, where the vessel well operation equipment comprises a dynamic telescopable elevator bail as described above.

In a second aspect the invention relates to a method in a well operation from a vessel comprising the use of a telescopable elevator bail as described above, where the elevator bail is adjusted longitudinally stepwise by:

- displacing an actuator actuable holding bolt from a locking position to a freed position;
- displacing the rod of the elevator bail relative to the sleeve of the elevator bail along a common longitudinal axis till a through opening in the sleeve is directly aligned with one hole in the rod; and
- displacing the actuator actuable holding bolt from the freed position to the locking position.

BRIEF DESCRIPTION OF THE DRAWINGS

In the following are described examples of preferred embodiment forms illustrated in the accompanying drawings, wherein.

DETAILED DESCRIPTION OF THE DRAWINGS

Figure 1:
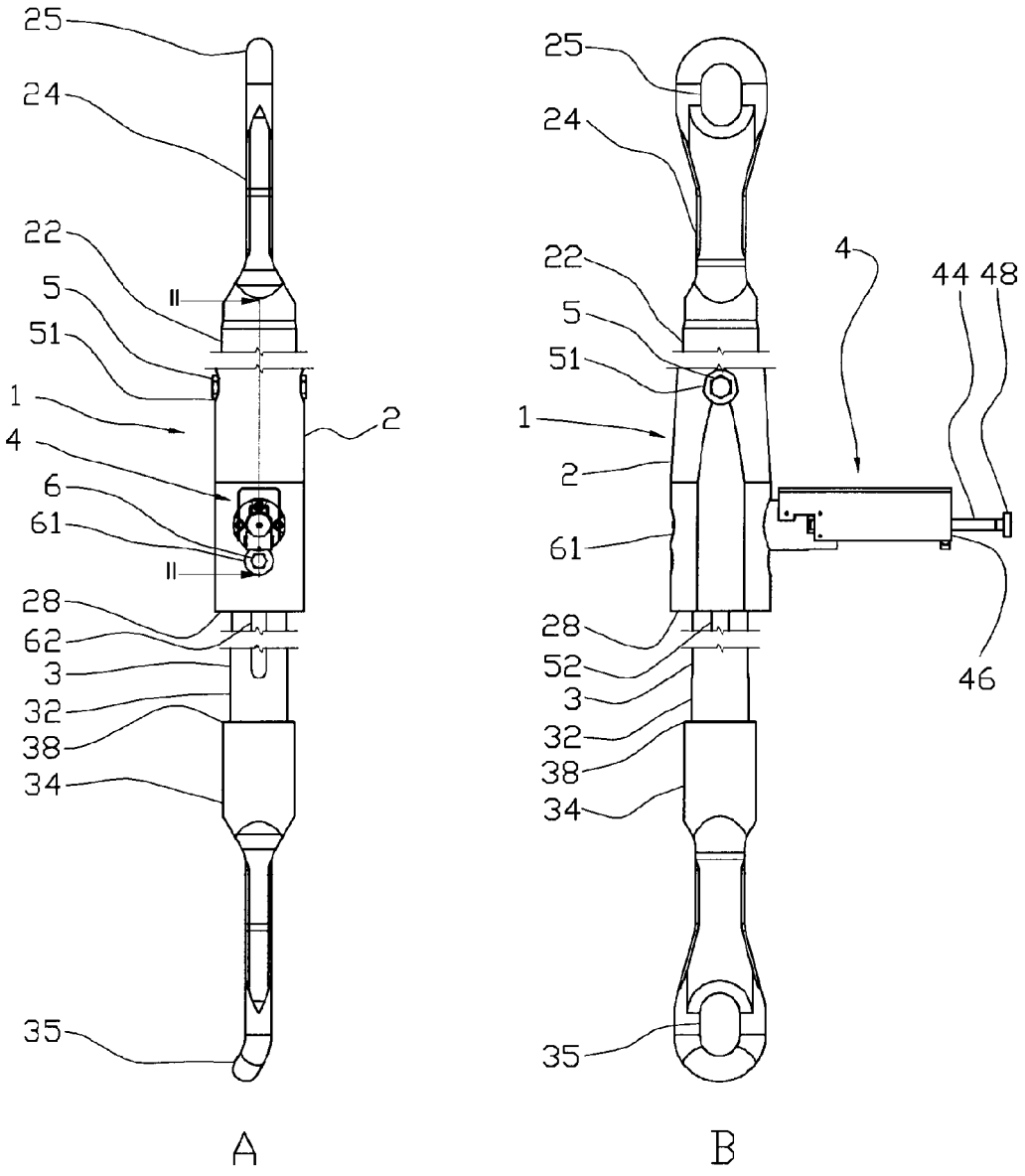
FIGS. 1A-B show a section of the end portions of a telescopable elevator bail and a mid-portion with an actuator for a bolt to an elevator bail, seen from two sides.

In the drawings the reference numeral 1 indicates a dynamically telescopable elevator bail according to the invention. The elevator bail 1 comprises a sleeve 2, a rod 3 and an actuator 4. In the working position the first end portion 22 of the sleeve 2 is provided with a first attachment organ 24 in the form of an eyepiece being able to be attached to a hook (not shown) by the eye 25 of the eyepiece 24 being treaded on to the hook. The first end portion 32 of the rod 3 is provided with a second attachment organ 34 in the form of an eyepiece being able to be attached to a lift (not shown) by means of the eye 35 of the eyepiece 34. The eyepiece 34 forms a shoulder 38 at the end portion 32 of the rod 3.

Figure 2:
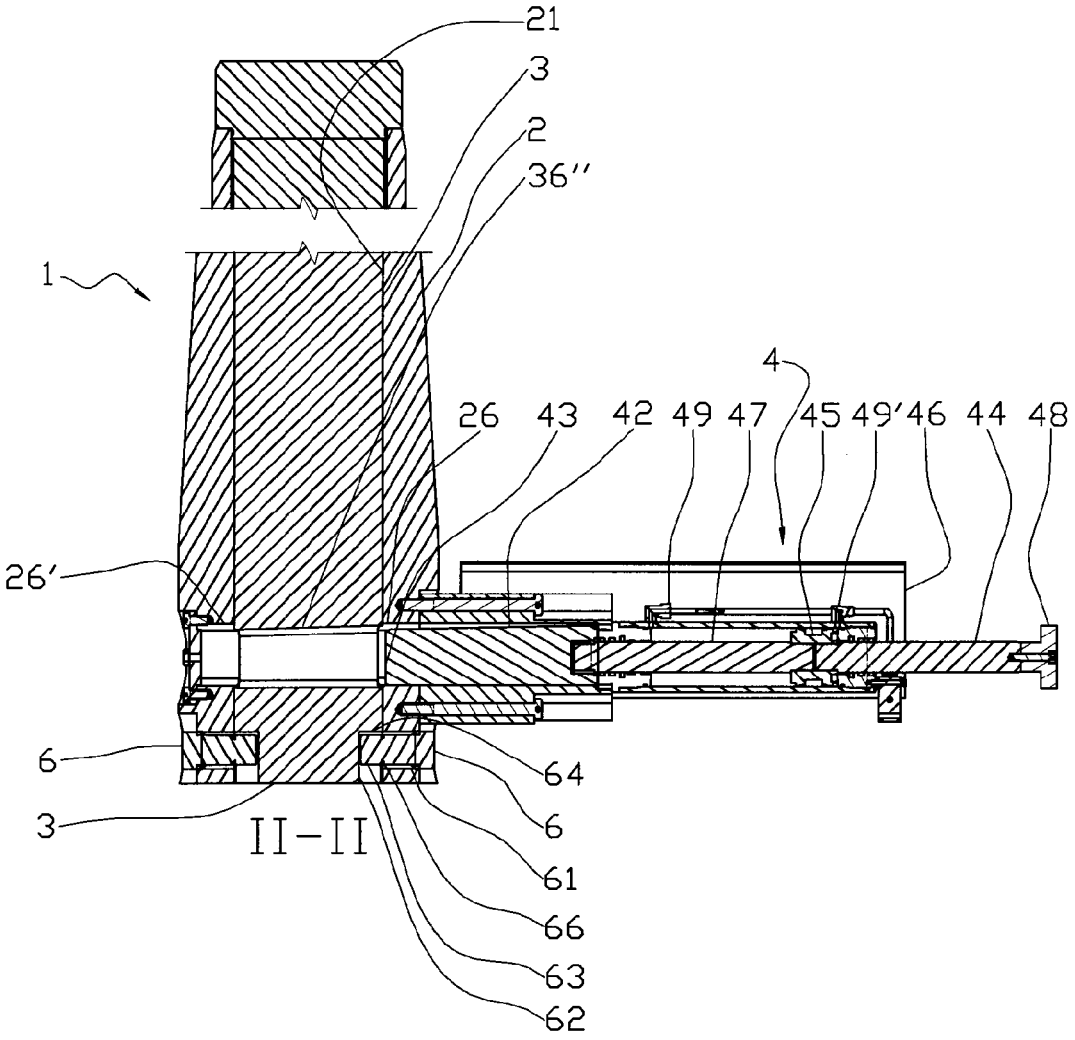
FIG. 2 shows a longitudinal section to a larger scale along line II-II in FIG. 1.
Figure 4:
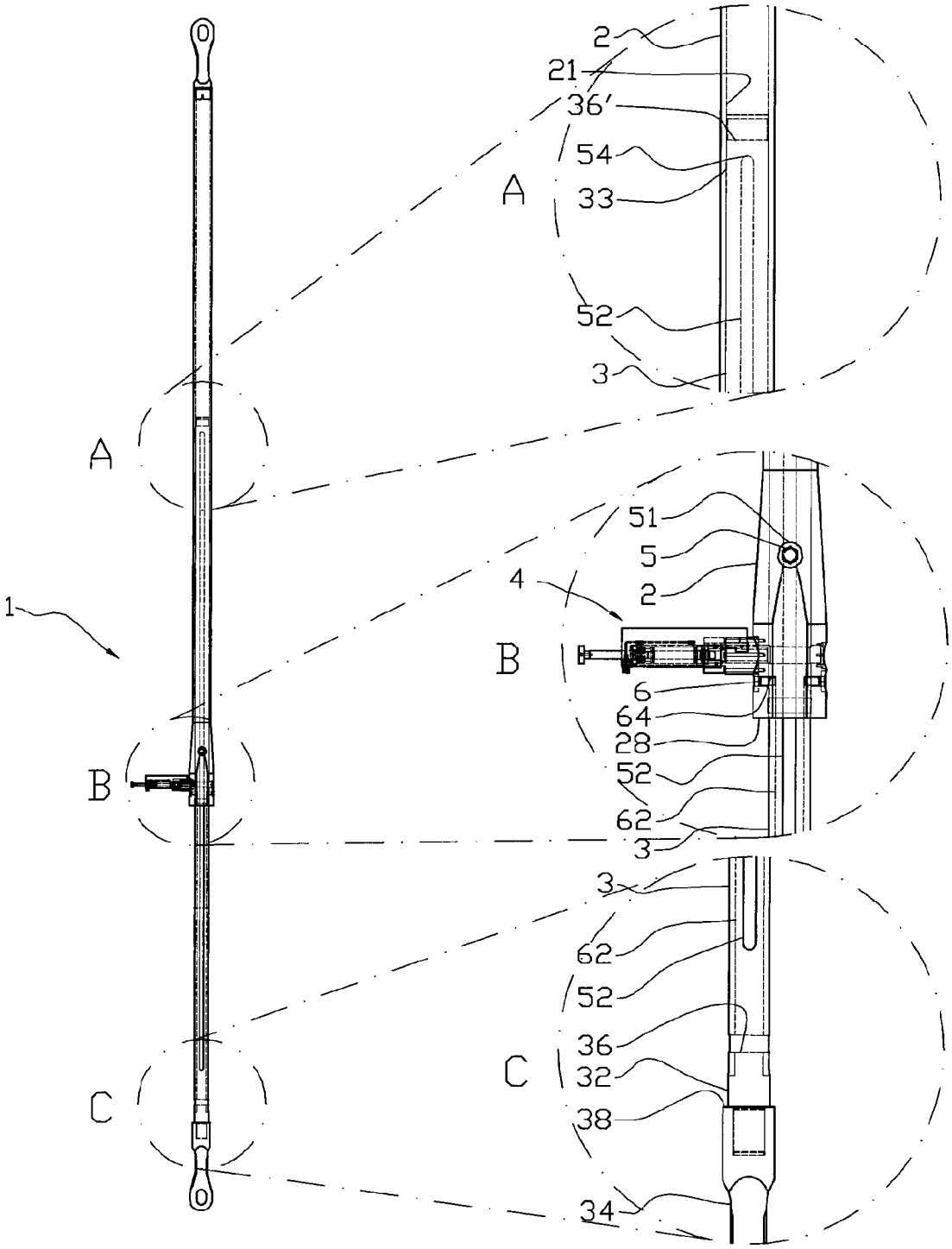
FIG. 4 shows a front elevation partly sectioned in a further other scale of the elevator bail in a working position and enlarged sections of the end portions and the mid-portion of the rod of the elevator bail.

The actuator 4 is attached to the sleeve 2. The actuator 4 may be a hydraulically powered actuator of a per se known type. The actuator 4 is arranged, by means of a hydraulically powered piston 45 connected to a holding bolt 42 by a piston rod 47, to be able to displace the holding bolt 42 from a freed position, as shown in FIG. 2, to a locking position as shown in the FIGS. 5B, 7 and 8 and back to the freed position. The actuator 4 is supplied with a hydraulic fluid through the ports 49, 49' in a per se known manner, and this is not discussed further. The holding bolt 42 is displaced through a first through opening 26 in the sleeve 2, through a hole 36, 36', 36" in the rod 3 and till the holding bolt 42 free end portion 43 is in engagement with the second opening 26' in the sleeve 2, see FIG. 7. The actuator 4 is provided with an indicator 44 moving with the piston 45. When the holding bolt 42 is in the freed position, the indicator 44 will project out past the free end portion 46 of the actuator 4, as shown in FIGS. 2 and 4. When the holding bolt 42 is in the locking position the free end portion 48 of the indicator 44 will be flush with the free end portion 46 of the actuator 4 as shown in the FIGS. 5 and 8. No more accounting for the design features of the actuator 4 is given, as the person versed in the art will know how a suitable actuator 4 may be designed. The openings 26, 26' and the hole 36, 36', 36" have a cross-section complementary to the cross-section of the holding bolt 42. The actuator 4 displaces the holding bolt 42 in a direction perpendicular to the longitudinal axis of the elevator bail 1. The actuator 4 is attached to the sleeve 2 adjacent the sleeve muzzle portion 28.

Figure 7:
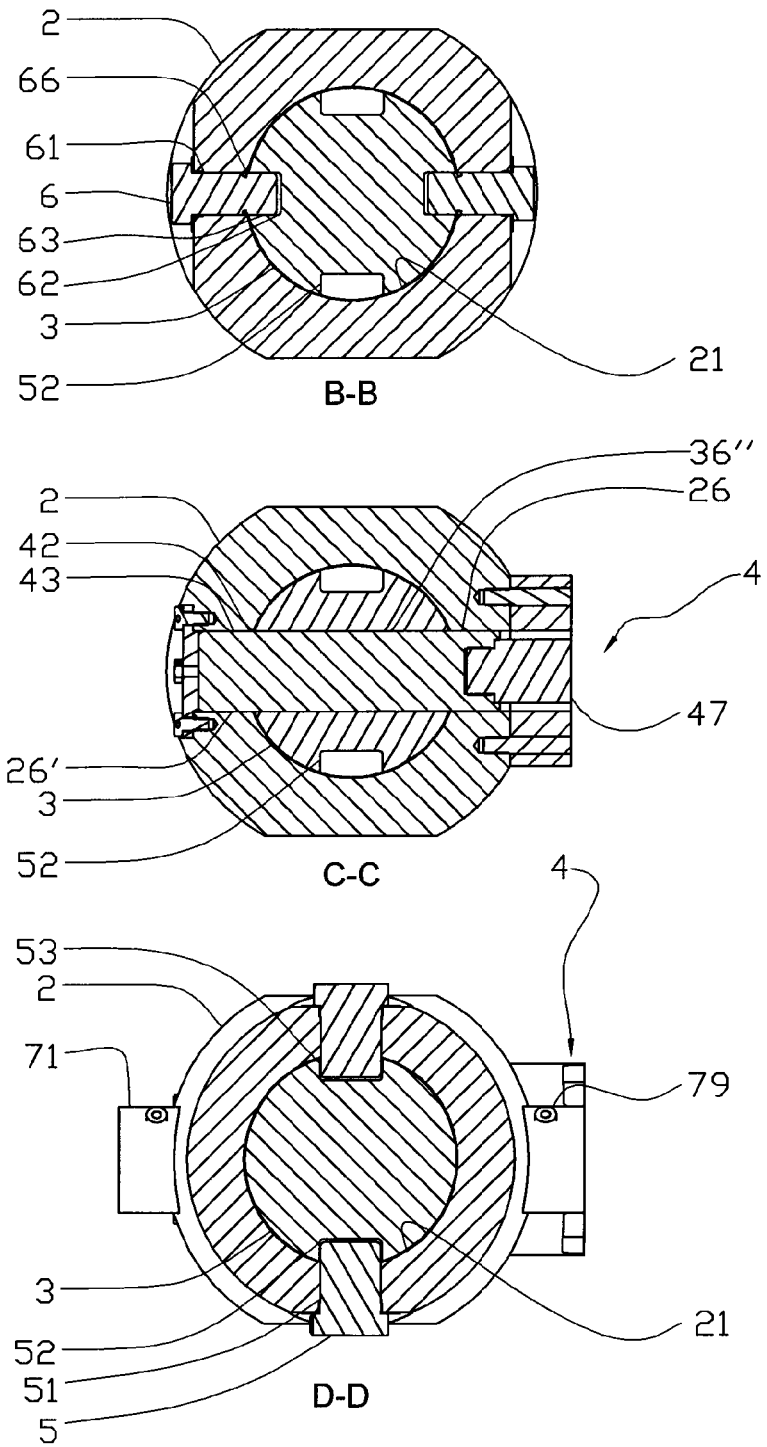
FIGS. 7A-C show to larger scale different sections along the elevator bail longitudinal axis.

The sleeve 2 is provided with one or more catch bolts 5 between the actuator 4 and the first end portion 22 of the sleeve 2. The catch bolt 5 is releasably attached in an opening 51 in the sleeve 2. The catch bolt 5 holding portion 53 forms a first contact portion 53 projecting inward in the sleeve 2 past the inner wall 21 of the sleeve 2 as shown in FIG. 7. An axially running, straight catch groove 52 is formed in a portion of the rod 3 surface as shown in the FIGS. 1, 3, 4, 7 and 9. The catch groove 52 runs from the first end portion 32 of the rod 3 and to the second end portion 33 of the rod 3 where the catch groove 52 is terminated in a first shoulder portion 54 forming a first abutment portion 54. The catch groove 52 cross-section fits complementary to the holding portion 53 of the catch bolt 5.

Figure 8:
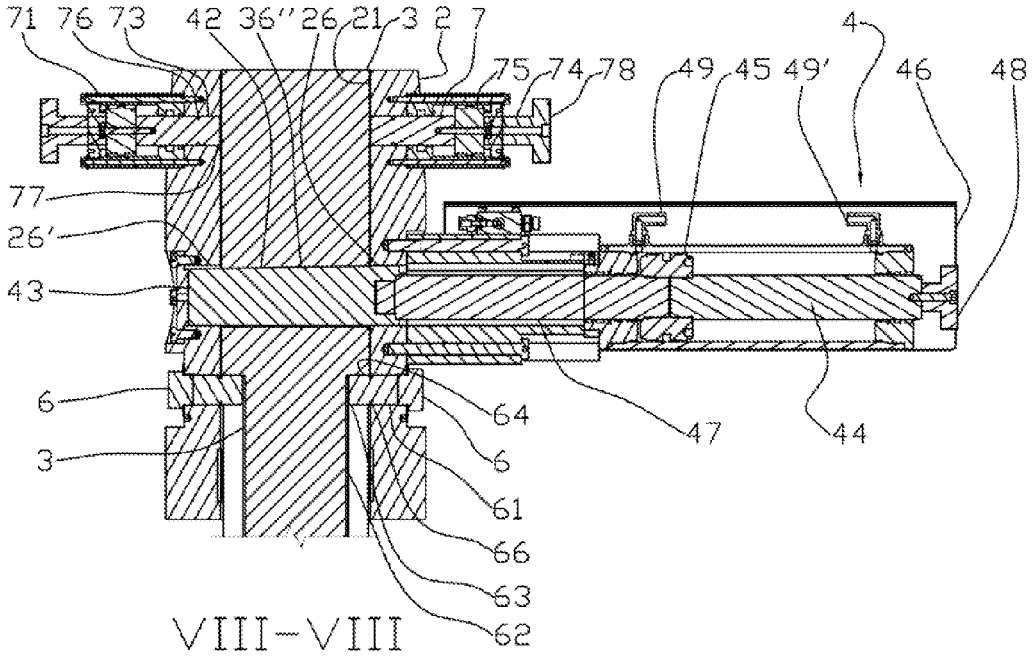
FIG. 8 shows to the same scale as in FIG. 2 a longitudinal section along the line VIII-VIII in FIG. 6 of the elevator bail in the alternative embodiment.

The sleeve 2 is provided with one or more fracture bolts 6 between the actuator 4 and the sleeve 2 muzzle portion 28. The fracture bolt 6 is releasably attached in an opening 61 in the sleeve 2. The free end portion 63 of the fracture bolt 6, constituting the fracture holding portion 63 of the fracture bolt 6, projects inward in the sleeve 2 past the inner wall 21 of the sleeve 2. The free end portion 63 of the fracture bolt 6 forms a second contact portion 63. An axially running, straight fracture groove 62 is formed in a portion of the rod 3 surface as shown in the Figures. The fracture groove 62 runs from the first end portion 32 of the rod 3 and to the mid portion of the rod 3 where the fracture groove 62 is terminated in a shoulder portion 64 forming a second abutment portion 64 see FIGS. 2, 5 and 8. The fracture groove 62 cross-section fits complementary to the fracture holding portion 63 of the fracture bolt 6. The fracture bolt 6 is constituted by a per se known material and is in a known manner provided with a crack initiation 66 as shown in FIGS. 2, 7 and 8. The person versed in the art will know how a fracture bolt 6 is to be formed to exhibit the desired breaking strength.

Figure 5:
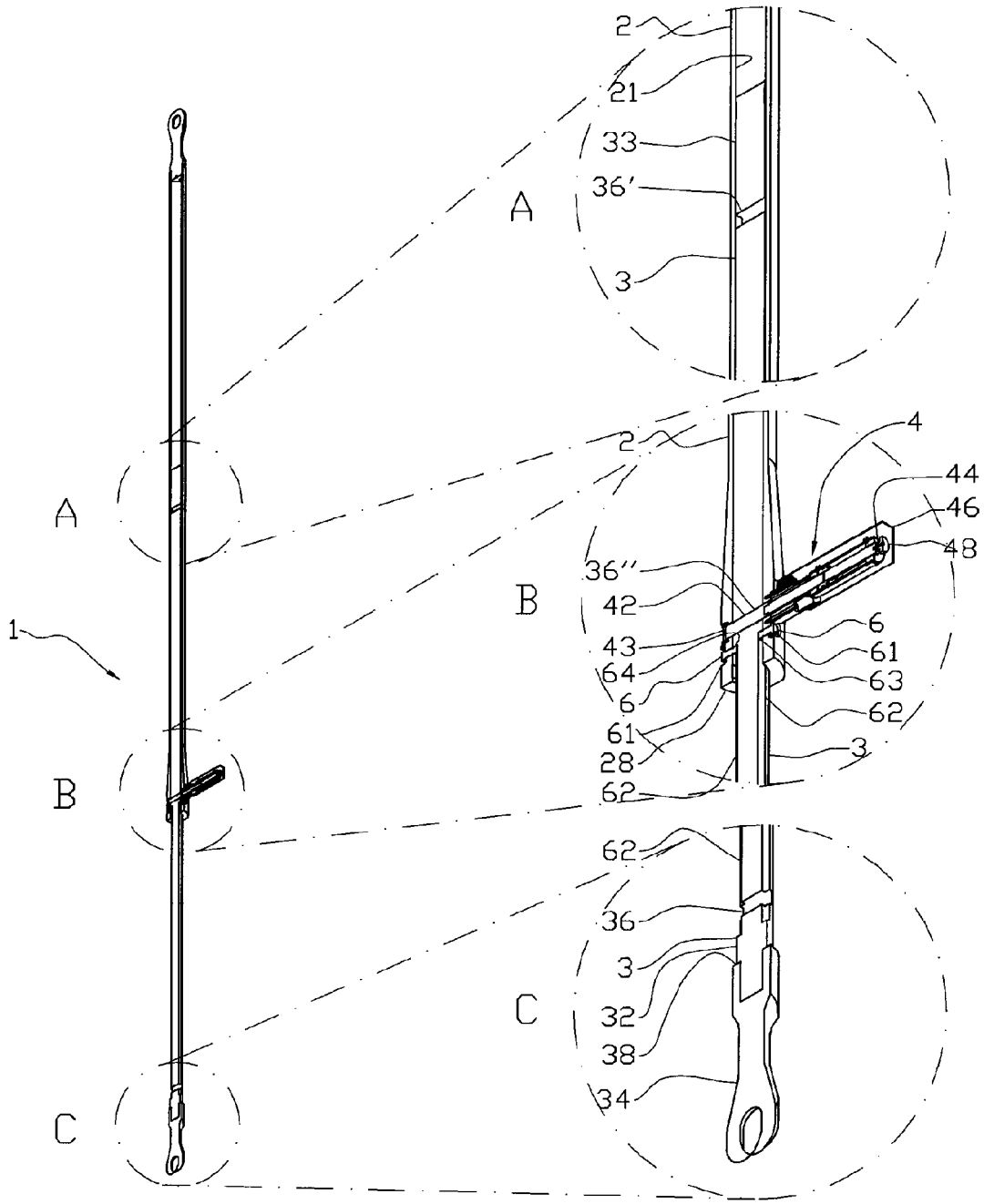
FIG. 5 shows to the same scale as in FIG. 4 a front elevation sectioned of an elevator bail in its working position and enlarged sections of the end portions and mid-portion of the rod of the elevator bail.

The rod 3 is provided with a first hole 36 in the first end portion 32 of the rod 3, a second hole 36' in a second end portion 33 of the rod 3 and a third hole 36" in the mid-portion of the rod 3 as shown in FIG. 5.

As shown in the drawings the dynamically telescopable elevator bail 1 is provided with two catch bolts 5 in the sleeve 2 and two appurtenant complementary catch grooves 52 in the rod 3. The catch bolts 5 are placed diametrically opposite on the sleeve 2. The elevator bail 1 is provided with two fracture bolts 6 and appurtenant two complementary fracture grooves 62 in the rod 3. The fracture bolts 6 are placed diametrically opposite on the sleeve 2 and at a distance of 90° on the catch bolts 5. In an alternative embodiment the elevator bail 1 may be provided with three or more catch bolts 5 at a mutual distance of less than 180° between two catch bolts 5. In a further alternative embodiment the elevator bail 1 may be provided with three or more fracture bolts 6 at a mutual distance of less than 180° between two fracture bolts 6. The person versed in the art will also know that there may be one catch bolt 5 and one fracture bolt 6, and a number of catch bolts 5 may be different from the number of fracture bolts 6. The rod 3 is being provided with at least as many catch grooves 52 and fracture grooves 62 as the number of catch bolts 5 and fracture bolts 6.

Figure 3:
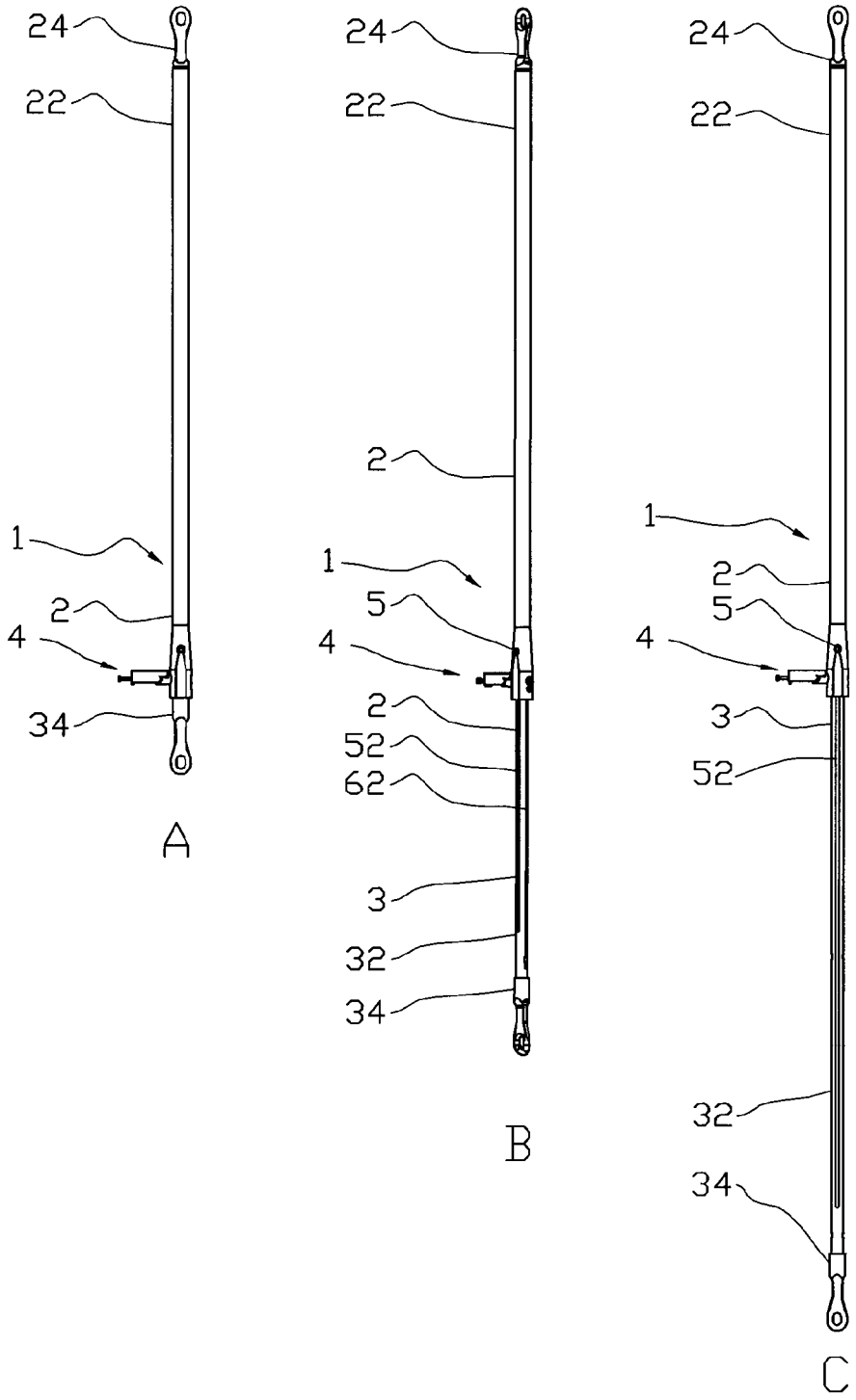
FIGS. 3A-C show a front elevation to a smaller scale of the telescopable elevator bail in A: transport position, B: in a working position and C: in a maximum outstretched position.

The elevator bail 1 may take up three static positions where the holding bolt 42 is displaced to the locking position. The three positions are the short working position, ordinary working position and the catch position of the elevator bail 1 as shown in FIG. 3. In the short working position, also equal to the position of the elevator bail 1 during transport and storage, the holding bolt 42 is pushed into the first hole 36 in the rod 3.

In the ordinary static working position the holding bolt 42 is pushed into the third hole 36" in the rod 3. In the ordinary static working position the second shoulder portion 64 of the rod 3 will rest against the fracture holding portion 63 of the fracture bolt 6 as shown in the FIGS. 2, 5 and 8. In execution of critical operations the actuator 4 displaces the holding bolt 42 from the locking position to the freed position and the elevator bail 1 is in the dynamic working position. The rod 3 will then on tension in the elevator bail 1 hang on the fracture holding portion 63 by the second shoulder portion 64. The fracture groove 62 allows the rod 3 to be displaced inward in the sleeve 2 when the vessel (not shown) moves down relative to the riser (not shown). It is thereby avoided that an outwardly directed movement arises in the elevator bail 1.

In an unexpected situation where for example the wave height exceeds the working range of the heave compensator (not shown), the tensile forces the elevator bail 1 is exposed to will exceed the breaking limit of the fracture bolt 6. The fracture bolt 6 is broken at the crack initiation 66 and the rod 3 will not be held back by the second shoulder portion 64. The rod 3 will be able to be pulled further out of the sleeve 2 and may be pulled further outward until the first shoulder portion 54 in the catch groove 52 hits the holding portion 53 of the catch bolt 5. Thereby the telescopable, dynamic elevator bail 1 is extended to its maximum, but such that the sleeve 2 and the rod 3 are still connected as one unit. In this in a sense undesired situation, the rod 3 may be freely displaced into and out of the sleeve 2, where the inward movement is limited by the shoulder 38 hitting against the sleeve muzzle portion 28, and where the outward movement is limited by the first shoulder portion 54 hitting against the holding portion 53 of the catch bolt 5. The free working range of the rod 3 comes in addition to the heave compensator working range, and together this causes that the vessel and the equipment escapes damage in an unexpected situation.

As soon as circumstances permit, the hook holding the elevator bail 1 is raised, until the first shoulder portion 54 of is the catch groove 52 is hanging on the holding portion 53 of the catch bolt 5. The holding bolt 42 is displaced by the actuator 4 to the locking position in the hole 36". The elevator bail 1 is then in the catch position. There is no need for personnel to be present on the floor during this operation. The elevator bail 1 is in this configuration stiff in that the sleeve 2 and the rod 3 may not be displaced relative to each other. Thereafter the necessary work operations to be able to return to an ordinary operating situation may be carried out.

Figure 6:
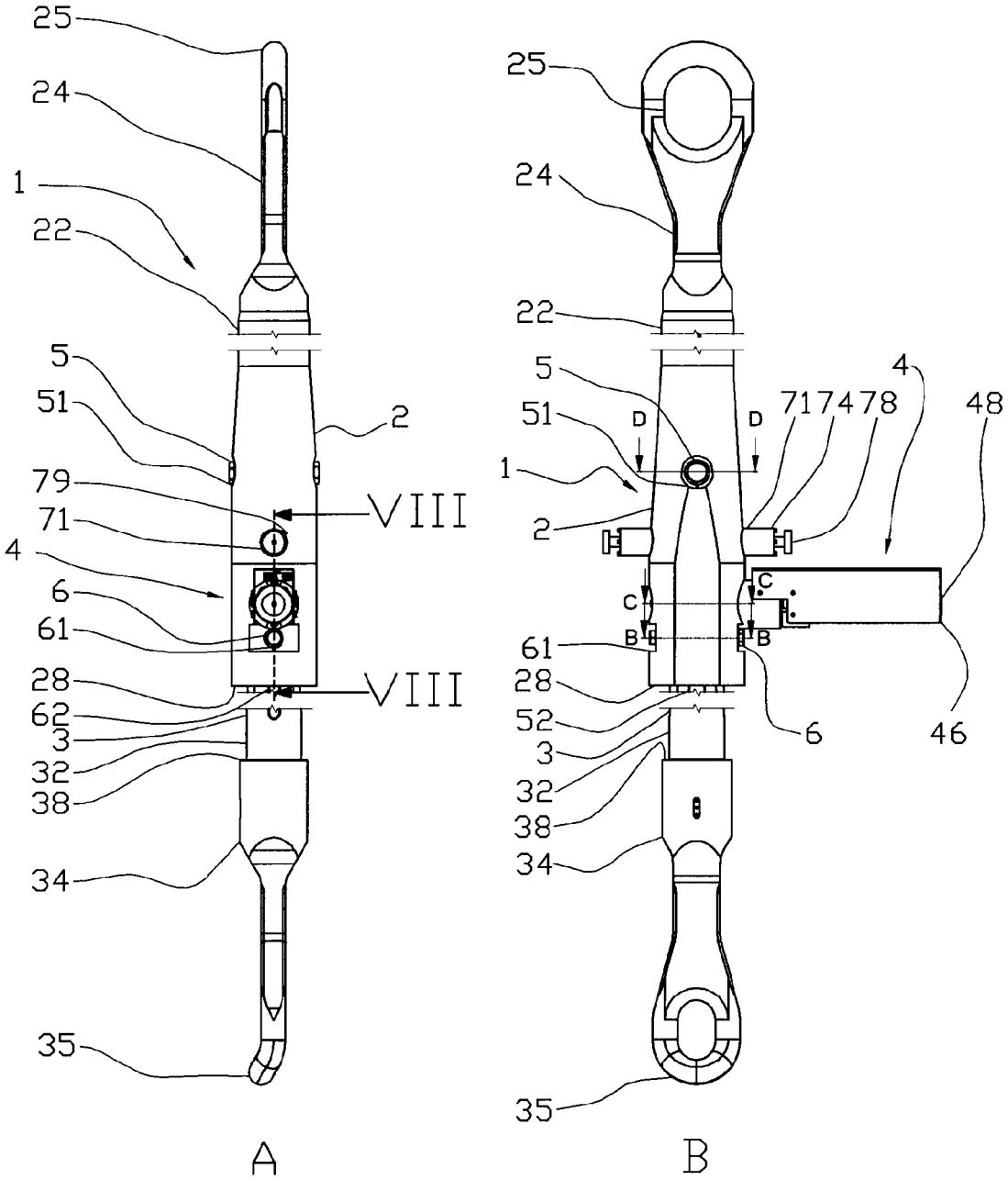
FIGS. 6A-B show to the same scale as in FIG. 1 the elevator bail in an alternative embodiment.
Figure 9:
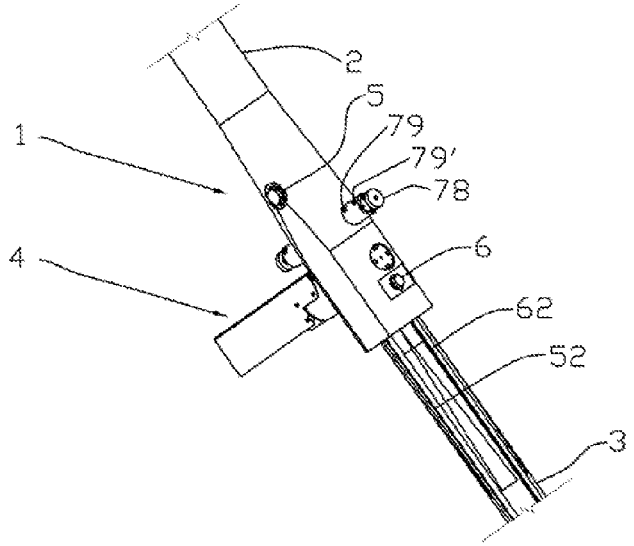
FIG. 9 shows to a different scale a perspective view of the elevator bail actuator, holding bolt, fracture bolt and secondary fracture bolt.

In an alternative embodiment the elevator bail 1 may be provided with a secondary, displaceable fracture bolt 7, as shown in the FIGS. 6, 8 and 9. The secondary fracture bolt 7 is surrounded by a housing 71. The secondary fracture bolt 7 is provided with a piston 75. The piston 75 is provided with an indicator 74 and such that the free end portion 78 of the indicator 74 projects out past the end portion of the housing 71 when the secondary fracture bolt 7 is not activated. The housing 71 is attached to the sleeve 2. The piston 75 may be a hydraulically powered piston 75 provided with a hydraulic fluid through the ports 79, 79' in a per se known manner, and this is not discussed further. On activation the piston 75 pushes the secondary fracture bolt 7 through a bore 77 in the sleeve 2. The secondary fracture bolt 7 is provided with a fracture groove 76. On activation the fracture-holding portion 73 of the secondary fracture bolt 7 will be accommodated by the fracture groove 62.

After the fracture bolt 6 is broken as described above, the secondary fracture bolt 7 may be activated when the situation allows without personnel being present on the floor during this operation. It is neither necessary to lift the hook holding the elevator bail 1 till the first shoulder portion 54 of the catch groove 52 is hanging on the holding portion 53 of the catch bolt 5, as described above. The secondary fracture bolt 7 is activated when it is established with certainty that second shoulder portion 64 of the fracture groove 62 is in a position above the secondary fracture bolt 7.

In an alternative embodiment the rod 3 is provided with additionally more holes 36 than described above. This has the advantage that the elevator bail 1 length may be set at several working lengths and thereby replace several elevator bails having fixed lengths. The person versed in the art will also know that the elevator bail attachment organ 24 or attachment organ 34 or both, in an alternative embodiment may be formed as a fork provided with a through bolt in the fork prongs to hold an equipment in an articulated manner.

The invention claimed is:

1. A telescopic elevator bail arranged to be used dynamically in well operations in the petroleum industry, the elevator bail comprising a tubular shaped sleeve provided with a first attachment organ at a first end portion and a muzzle portion, and a straight rod with a first end portion and a second end portion, the second end portion being positioned inside the sleeve, the rod being arranged to be displaced telescopically relative to the sleeve along a common longitudinal axis of the sleeve and the rod; and the rod being provided with at least one through hole perpendicular to the longitudinal axis of the rod and the hole being arranged to accommodate an actuator actuable holding bolt, wherein the rod in its second end portion is provided with at least one first abutment portion and the sleeve is provided with at least one first contact portion arranged to be able to support the first abutment portion of the rod when the sleeve and the rod exhibit their longest relative longitudinal displacement.

2. An elevator bail according to claim 1, wherein the first abutment portion comprises a first shoulder portion, and the sleeve is provided with at least one catch bolt; wherein the catch bolt is provided with an inward projecting holding portion forming the first contact portion.

3. An elevator bail according to claim 2, wherein at least one axially running, straight catch groove is formed in a portion of the rod surface and arranged to accommodate the holding portion of the catch bolt.

4. An elevator bail according to claim 2, wherein the catch bolt is positioned between the holding bolt and the attachment organ of the sleeve.

5. An elevator bail according to claim 1, wherein the rod is provided with at least one second abutment portion and the sleeve is provided with at least one second contact portion arranged to support the second abutment portion of the rod when the sleeve and the rod exhibit their longest working length displacement.

6. An elevator bail according to claim 5, wherein the second abutment portion comprises a second shoulder portion, and the sleeve is provided with at least one fracture bolt; wherein the fracture bolt is provided with an inward projecting fracture holding portion forming the second contact portion.

7. An elevator bail according to claim 6, wherein at least one axially running, straight fracture groove is formed in a portion of the rod surface and arranged to accommodate the fracture holding portion of the fracture bolt.

8. An elevator bail according to claim 6, wherein the fracture bolt is positioned between the holding bolt and the muzzle portion of the sleeve.

9. An elevator bail according to claim 1, wherein the sleeve is further provided with at least one longitudinally displaceable secondary fracture bolt; the secondary fracture bolt being provided with a fracture holding portion projecting inward in the sleeve when the secondary fracture bolt is activated.

10. An elevator bail according to claim 9, wherein the secondary fracture bolt is positioned between the holding bolt and the catch bolt.

11. An elevator bail arranged to be used dynamically in well operations in the petroleum industry and adapted for use with vessel well intervention equipment, the elevator bail comprising a tubular shaped sleeve provided with a first attachment organ at a first end portion and a muzzle portion, and a straight rod with a first end portion and a second end portion, the second end portion being positioned inside the sleeve, the rod being arranged to be displaced telescopically relative to the sleeve along a common longitudinal axis of the sleeve and the rod; and the rod being provided with at least one through hole perpendicular to the longitudinal axis of the rod and the hole being arranged to accommodate an actuator actuable holding bolt, wherein the rod in its second end portion is provided with at least one first abutment portion and the sleeve is provided with at least one first contact portion arranged to support the first abutment portion of the rod when the sleeve and the rod exhibit their longest relative longitudinal displacement.

12. A method in a well operation comprising the use of a dynamically telescopable elevator bail arranged to be used dynamically in well operations in the petroleum industry and adapted for use on a vessel, the elevator bail comprising a tubular shaped sleeve provided with a first attachment organ at a first end portion and a muzzle portion, and a straight rod with a first end portion and a second end portion, the second end portion being positioned inside the sleeve, the rod being arranged to be displaced telescopically relative to the sleeve along a common longitudinal axis of the sleeve and the rod; and the rod being provided with at least one through hole perpendicular to the longitudinal axis of the rod and the hole being arranged to accommodate an actuator actuable holding bolt, wherein the rod in its second end portion is provided with at least one first abutment portion and the sleeve is provided with at least one first contact portion arranged to support the first abutment portion of the rod when the sleeve and the rod exhibit their longest relative longitudinal displacement;

wherein the elevator bail is stepwise adjusted longitudinally by:

displacing an actuator actuable holding bolt from a locking position to a freed position;

displacing the rod of the elevator bail relative to the sleeve of the elevator bail along a common longitudinal axis until a through opening in the sleeve is directly aligned with one hole in the rod; and displacing the actuator actuable holding bolt from the freed position to the locking position.

13. A telescopic elevator bail arranged to be used dynamically in well operations in the petroleum industry, the elevator bail comprising a sleeve provided with a first attachment organ and a muzzle portion, and a rod arranged to be displaced telescopically relative to the sleeve along a common longitudinal axis of the sleeve and the rod, and the rod being provided with at least one through hole perpendicular to the longitudinal axis of the rod and the hole being arranged to accommodate an actuator actuable holding bolt, wherein the rod in a second end portion is provided with at least one first abutment portion and the sleeve is provided with at least one first contact portion arranged to support the first abutment portion of the rod when the sleeve and the rod exhibit their longest relative longitudinal displacement, wherein the first abutment portion comprises a first shoulder portion, and the sleeve is provided with at least one catch bolt, wherein the catch bolt is provided with an inward projecting holding portion forming the first contact portion.

14. An elevator bail according to claim 13, wherein at least one axially running, straight catch groove is formed in a portion of the rod surface and arranged to accommodate the holding portion of the catch bolt.

15. An elevator bail according to claim 13, wherein the rod is provided with at least one second abutment portion and the sleeve is provided with at least one second contact portion arranged to support the second abutment portion of the rod when the sleeve and the rod exhibit their longest working length displacement.

16. An elevator bail according to claim 15, wherein the second abutment portion comprises a second shoulder portion, and the sleeve is provided with at least one fracture bolt, wherein the fracture bolt is provided with an inward projecting fracture holding portion forming the second contact portion.

17. An elevator bail according to claim 16, wherein at least one axially running, straight fracture groove is formed in a portion of the rod surface and arranged to accommodate the fracture holding portion of the fracture bolt.

18. An elevator bail according to claim 16, wherein the fracture bolt is positioned between the holding bolt and the muzzle portion of the sleeve.

19. An elevator bail according to claim 13, wherein the catch bolt is positioned between the holding bolt and the attachment organ of the sleeve.

20. An elevator bail according to claim 13, wherein the sleeve is further provided with at least one longitudinally displaceable secondary fracture bolt, the secondary fracture bolt being provided with a fracture holding portion projecting inward in the sleeve when the secondary fracture bolt is activated.

21. An elevator bail according to claim 20, wherein the secondary fracture bolt is positioned between the holding bolt and the catch bolt.

22. A method in a well operation comprising the use of a dynamically telescopable elevator bail arranged to be used dynamically in well operations in the petroleum industry and adapted for use on a vessel, the elevator bail comprising a sleeve provided with a first attachment organ and a muzzle portion, and a rod arranged to be displaced telescopically relative to the sleeve along a common longitudinal axis of the sleeve and the rod, and the rod being provided with at least one through hole perpendicular to the longitudinal axis of the rod and the hole being arranged to accommodate an actuator actuable holding bolt, wherein the rod in its second portion is provided with at least one first abutment portion and the sleeve is provided with at least one first contact portion arranged to support the first abutment portion of the rod when the sleeve and the rod exhibit their longest relative longitudinal displacement, wherein the first abutment portion comprises a first shoulder portion, and the sleeve is provided with at least one catch bolt, wherein the catch bolt is provided with an inward projecting holding portion forming the first contact portion, wherein the elevator bail is stepwise adjusted longitudinally by:

displacing an actuator actuable holding bolt from a locking position to a freed position;

displacing the rod of the elevator bail relative to the sleeve of the elevator bail along a common longitudinal axis until a through opening in the sleeve is directly aligned with one hole in the rod; and displacing the actuator actuable holding bolt from the freed position to the locking position.

* * * * *